US010161100B2

(12) United States Patent
Koop

(10) Patent No.: US 10,161,100 B2
(45) Date of Patent: Dec. 25, 2018

(54) ADJUSTABLE MANHOLE COVER

(71) Applicant: 1128653 Ontario Ltd., Leamington (CA)

(72) Inventor: Benjamin Koop, Leamington (CA)

(73) Assignee: 1128653 Ontario Ltd., Ontario (CA)

( * ) Notice: Subject to any disclaimer, the term of this patent is extended or adjusted under 35 U.S.C. 154(b) by 310 days.

(21) Appl. No.: 14/575,312

(22) Filed: Dec. 18, 2014

(65) Prior Publication Data

US 2016/0177535 A1 Jun. 23, 2016

(51) Int. Cl.
*E02D 29/14* (2006.01)

(52) U.S. Cl.
CPC ..... *E02D 29/1409* (2013.01); *E02D 29/1445* (2013.01)

(58) Field of Classification Search
USPC ..... 404/26; 285/42; 52/20; 254/131
See application file for complete search history.

(56) References Cited

U.S. PATENT DOCUMENTS 599,441 A * 2/1898 Dorr ..... E02D 29/1409 404/26
638,692 A * 12/1899 Banwell ..... E02D 29/1409 210/164
1,165,044 A * 12/1915 Tyler ..... E02D 29/1409 404/26
1,389,542 A * 8/1921 Wereley ..... F22B 37/221 138/89
1,408,982 A * 3/1922 Calhoun ..... E02D 29/1427 404/26
1,447,256 A * 3/1923 Lincoln ..... E02D 29/1409 404/26

(Continued)

FOREIGN PATENT DOCUMENTS

DE 3604164 A1 * 8/1986 ..... E02D 29/1427

OTHER PUBLICATIONS

YouTube video: Ant Hire Solutions, "Forged Steel Manhole Keys Designed for Strength" https://www.youtube.com/watch?v=gthOzg8LnFo (Year: 2010).*

(Continued)

*Primary Examiner* — Thomas B Will
*Assistant Examiner* — Katherine J Chu
(74) *Attorney, Agent, or Firm* — Carlson, Gaskey & Olds, P.C.

(57) ABSTRACT

A manhole cover assembly has an inner cylinder and an outer cylinder. An upper ratchet mechanism extends axially and circumferentially about an outwardly facing surface of the inner cylinder. A lower ratchet mechanism extends axially and circumferentially about an inwardly facing surface of the outer. The lower ratchet mechanism is configured to mesh with the upper ratchet mechanism at one of a plurality of distinct ratcheting positions. A cover plate is disposed on one of the inner cylinder and the outer cylinder. The cover plate is at a first elevation when the lower ratchet mechanism meshes with the upper ratchet mechanism at a first distinct ratcheting position. The cover plate is at a second elevation when the lower ratchet mechanism meshes with the upper ratchet mechanism at a second distinct ratcheting position. The first elevation is different from the second elevation.

20 Claims, 5 Drawing Sheets

(56) References Cited

U.S. PATENT DOCUMENTS 1,673,145 A * 6/1928 Gschwind ..... E02D 29/1409 404/26
1,792,345 A * 2/1931 Williams ..... E03F 5/0407 137/362
3,362,684 A * 1/1968 Davenport ..... B66F 19/005 254/131
3,629,981 A * 12/1971 McCaffery ..... E02D 29/1409 404/26
4,075,796 A * 2/1978 Cuozzo ..... E02D 29/1409 404/26
4,273,467 A 6/1981 Cronk
4,505,814 A * 3/1985 Marshall ..... E04D 13/0409 210/166
4,572,566 A * 2/1986 Terrington ..... B65G 7/12 294/118
4,593,714 A * 6/1986 Madden ..... B65D 90/105 137/314
4,614,065 A * 9/1986 Papp ..... E02D 29/1409 404/26
4,620,330 A * 11/1986 Izzi, Sr. ..... E03C 1/12 138/89
4,828,274 A * 5/1989 Stannard ..... F16J 15/022 220/378
4,934,715 A * 6/1990 Johnson ..... E02D 29/14 220/378
5,095,667 A * 3/1992 Ryan ..... E02D 29/1409 285/42
5,211,504 A * 5/1993 Trudel ..... E02D 29/1409 404/26
5,360,131 A * 11/1994 Phillipps ..... E02D 29/1409 220/3.7
5,525,006 A * 6/1996 Kilman ..... E02D 29/12 404/25
5,628,152 A 5/1997 Bowman
5,727,351 A * 3/1998 Neathery ..... E02D 29/12 292/237
5,865,425 A * 2/1999 Meadows ..... B66F 19/005 254/131
6,202,986 B1 * 3/2001 Goldman ..... B66F 19/005 254/131
6,311,433 B1 * 11/2001 Zdroik ..... E02D 29/1409 404/26
6,439,628 B1 * 8/2002 Eslambolchi ..... B66F 19/005 254/131
6,524,026 B2 * 2/2003 Sondrup ..... E02D 29/1445 404/26
6,595,566 B1 * 7/2003 Donnan ..... B66F 19/005 294/118
7,735,512 B1 * 6/2010 Ismert ..... E03F 5/0407 137/362
8,347,424 B2 * 1/2013 Wroblewski ..... E03F 5/0407 137/362
8,382,392 B2 * 2/2013 Liao ..... E02D 29/14 404/26
8,540,454 B2 * 9/2013 Lee ..... E02D 29/14 404/26
2001/0003886 A1 * 6/2001 Mihalicz ..... E02D 17/10 52/20
2002/0166291 A1 * 11/2002 Campbell ..... E02D 29/14 52/20
2003/0235467 A1 * 12/2003 Gamson ..... E02D 29/1409 404/26
2007/0081857 A1 * 4/2007 Yoon ..... E02D 29/124 404/26

OTHER PUBLICATIONS

YouTube video: dereton33, "How to lift drain covers. (Man hole covers) to clear blocked drains." https://www.youtube.com/watch?v=age-d1eC2ZM&t=186s (Year: 2015).*

Allpipe Stoppers & Ground Equipment website, selling manhole keys http://www.allpipe.co.uk/products/detail/manhold-cover-lifting/manhole-keys (Year: 2013).*

Kim, Ch.H., and J.H. Park, Development of a height-adjustable manhole, Journal of Achievements in Materials and Manufacturing Engineering, Dec. 31, 2005, p. 21-25, vol. 14, Issue 1-2 Jan.-Feb. 2006, International OCSCO World Press.

* cited by examiner

ADJUSTABLE MANHOLE COVER

BACKGROUND

This disclosure relates to a manhole cover, and more particularly an adjustable manhole cover. Over time, manhole cover systems can undesirably sink relative to the surrounding environment.

SUMMARY

A manhole cover assembly has an inner cylinder and an outer cylinder. An upper ratchet mechanism extends axially and circumferentially about an outwardly facing surface of the inner cylinder. A lower ratchet mechanism extends axially and circumferentially about an inwardly facing surface of the outer cylinder. The lower ratchet mechanism is configured to mesh with the upper ratchet mechanism at one of a plurality of distinct ratcheting positions. A cover plate is disposed on one of the inner cylinder or the outer cylinder. The cover plate is at a first elevation when the lower ratchet mechanism meshes with the upper ratchet mechanism at a first distinct ratcheting position. The cover plate is at a second elevation when the lower ratchet mechanism meshes with the upper ratchet mechanism at a second distinct ratcheting position. The first elevation is different from the second elevation.

In another example of the foregoing assembly, the inner cylinder and the outer cylinder are disposed about an axis, and the inner cylinder is radially inward of the outer cylinder.

In another example of any of the foregoing assemblies, the cover plate is disposed on the inner cylinder.

In another example of any of the foregoing assemblies, the inner cylinder is integral with the cover plate.

In another example of any of the foregoing assemblies, the cover plate includes openings to receive tools. The openings permit the tools to engage the cover plate.

In another example of any of the foregoing assemblies, the openings are linear slots.

In another example of any of the foregoing assemblies, the cover plate is integral with the inner cylinder.

In another example of any of the foregoing assemblies, the outer cylinder is configured to receive the inner cylinder through a top opening of the outer cylinder.

In another example of any of the foregoing assemblies, the upper ratchet mechanism is a linear gear.

In another example of any of the foregoing assemblies, the upper ratchet mechanism is a first upper ratchet mechanism. The inner cylinder further comprises a second upper ratchet mechanism extending axially and circumferentially about the outwardly facing surface. The first upper ratchet mechanism is circumferentially spaced from the second upper ratchet mechanism.

In another example of any of the foregoing assemblies, the inner cylinder comprises a third upper ratchet mechanism extending axially and circumferentially about the outwardly facing surface. The third upper ratchet mechanism is spaced circumferentially from the first and second upper ratchet mechanisms.

In another example of any of the foregoing assemblies, the lower ratchet mechanism is a first lower ratchet mechanism. The outer cylinder further comprises a second lower ratchet mechanism extending axially and circumferentially about the outwardly facing surface. The first lower ratchet mechanism is circumferentially spaced from the second lower ratchet mechanism. The second lower ratchet mechanism is configured to mesh with the second upper ratchet mechanisms at the one of the plurality of distinct ratcheting positions.

A method for adjusting a manhole cover includes moving an inner cylinder axially in a first direction from a first position, rotating the inner cylinder relative to an outer cylinder, and moving the inner cylinder axially in a direction opposite the first direction to a second position. The first position is axially distinct from the second position.

In another example of the foregoing method, the cover plate is integral with the inner cylinder.

In another example of the foregoing method, the first position provides a first elevation of the cover plate and the second position provides a second elevation of the cover plate. The first elevation is different from the second elevation.

In another example of the foregoing method, before the first direction moving step, inserting a tool into an opening in the cover plate.

In another example of the foregoing method, the inner cylinder includes a first ratchet mechanism, and the outer cylinder includes a second ratchet mechanism configured to mesh with the first ratchet mechanism at a plurality of distinct ratcheting positions.

In another example of the foregoing method, moving the inner cylinder axially in a first direction disengages an upper ratchet mechanism from a lower ratchet mechanism.

In another example of the foregoing method, moving the inner cylinder axially in a second direction reengages the upper ratchet mechanism with the lower ratchet mechanism.

In another example of the foregoing method, moving the inner cylinder axially in a first direction is an upward lifting movement.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The various features and advantages of this disclosure will become apparent to those skilled in the art from the following detailed description. The drawings that accompany the detailed description can be briefly described as follows.

DETAILED DESCRIPTION

Figure 1:
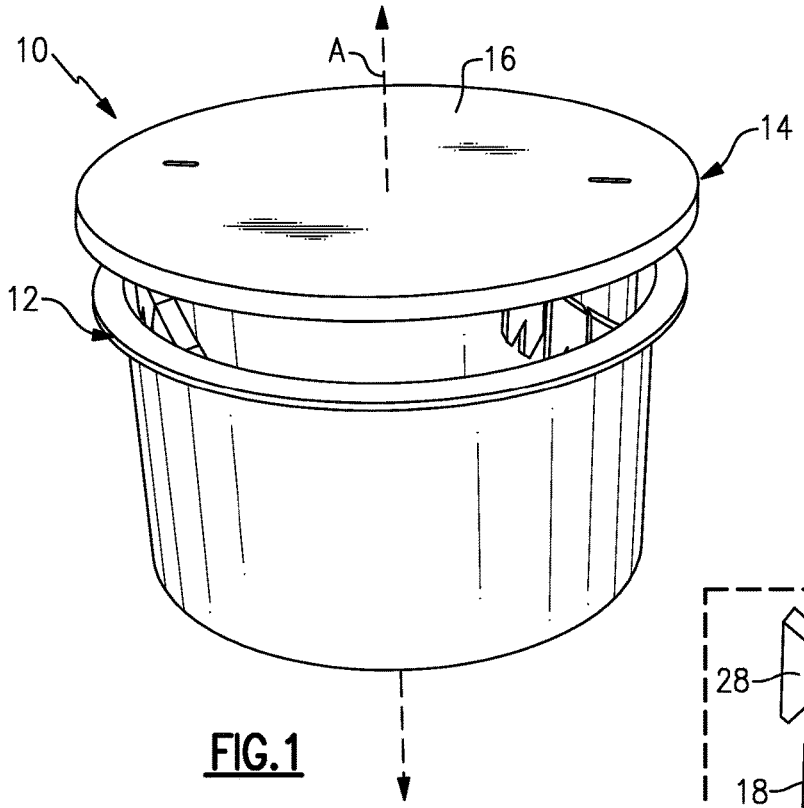
FIG. 1 shows a perspective view of an example adjustable manhole cover assembly at a first axial position.

Referring to FIGS. 1 to 4, an example adjustable manhole cover assembly 10 includes an outer cylinder 12 and an inner cylinder 14. The outer cylinder 12 receives the inner cylinder 14 such that the outer cylinder 12 is radially outward of the inner cylinder 14 when disposed about an axis A. A cover plate 16 is disposed on the inner cylinder 14 in this example.

In this embodiment, the outer cylinder 12 is secured within an access hole 15 in a surface 19, one example being a road. The inner cylinder 14 is then lowered within the outer cylinder 12, effectively covering the access hole 15 with cover plate 16.

An access hole may be any opening in a floor, pavement, or other surface. In one example, an access hole provides human access to an underground utility vault, such as sewers, telephone, electricity, storm drains or gas.

Figure 1A:
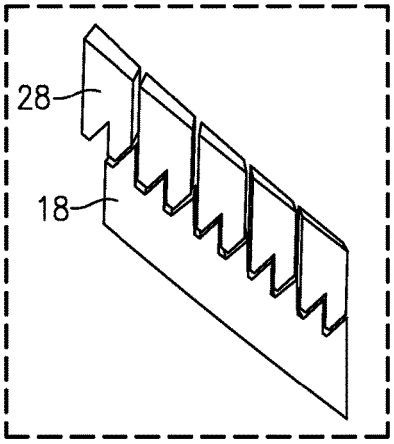
FIG. 1A shows a ratchet mechanism of the adjustable manhole cover assembly of FIG. 1.
Figure 1B:
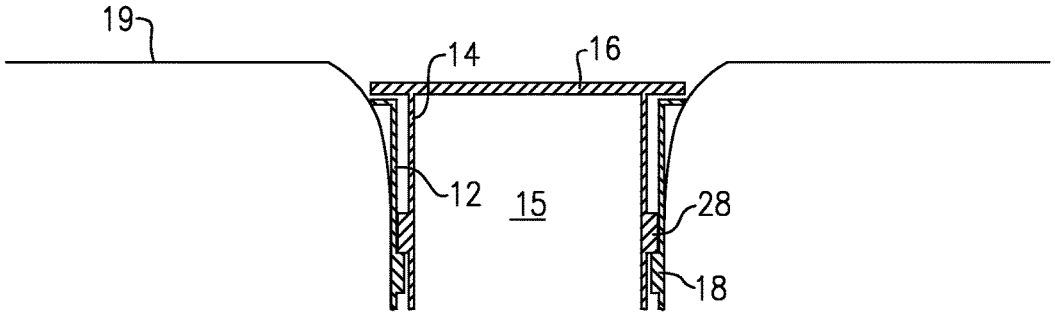
FIG. 1B shows a cross-sectional view of the adjustable manhole cover assembly of FIG. 1 within an access hole.
Figure 2:
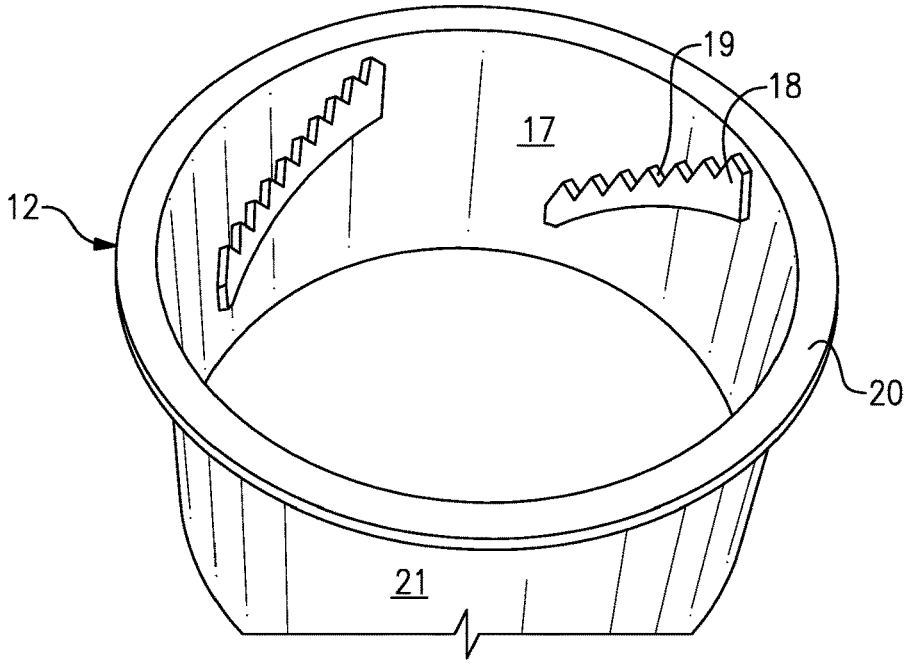
FIG. 2 shows a perspective view of an example outer cylinder of the adjustable manhole cover assembly of FIG. 1.
Figure 3:
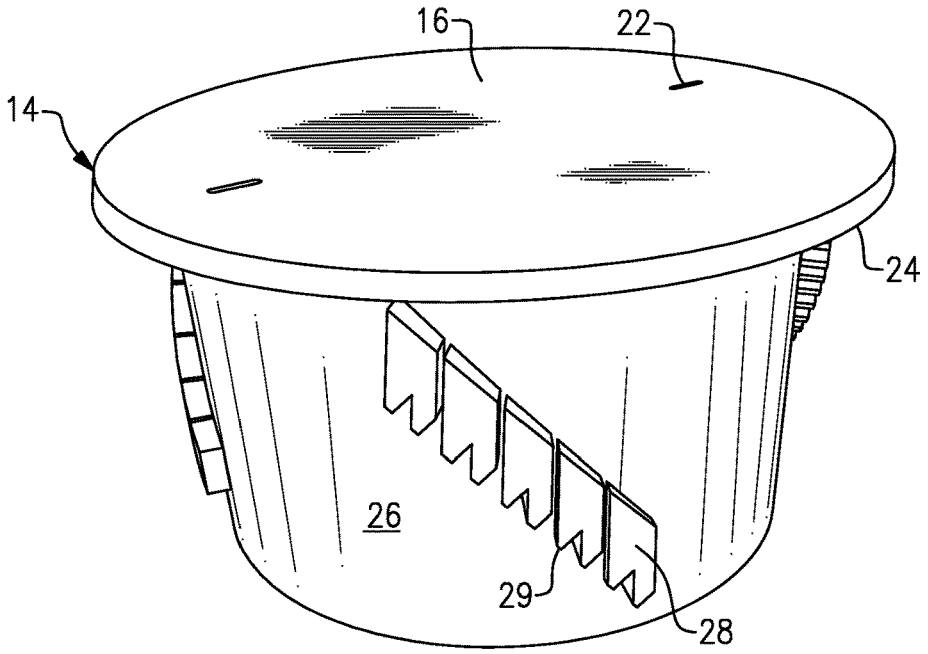
FIG. 3 shows a perspective view of an example inner cylinder of the adjustable manhole cover assembly of FIG. 1.
Figure 4:
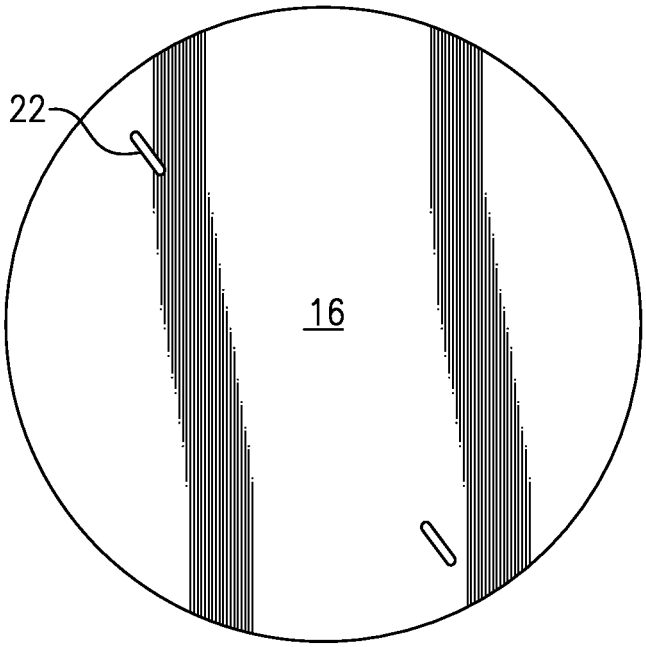
FIG. 4 shows a top view of an example cover of the adjustable manhole cover assembly of FIG. 1.

Over time, the manhole cover assembly 10 may sink within the access hole 15 relative to the surrounding surface 19, causing the relative height of cover plate 16 to be lower than the surrounding surface 19, as shown in FIG. 1B.

The outer cylinder 12 includes an inner surface 17 having at least one ratchet mechanism 18. The example inner surface 17 includes four ratchet mechanisms 18 circumferentially spaced from one another and distributed about the axis A. More than four or fewer than four ratchet mechanisms 18 could be used in other examples.

Each example ratchet mechanism 18 is a linear gear with teeth 19. The ratchet mechanism 18 extends axially and circumferentially along the inner surface 17, extending circumferentially clockwise as it extends axially upward toward the cover plate 16. The teeth 19 provide a plurality of distinct ratcheting positions.

The outer cylinder 12 further includes an annular ring 20 extending radially outward from an outer surface 21 and at the uppermost edge of the outer cylinder 12. The outer cylinder 12 is configured to be secured to a manhole. In one example, the ring 20 provides a contact surface for features within the manhole, such that the features provide an upward force on the outer cylinder 12 to oppose the downward gravitational force on the outer cylinder 12.

The outer surface 26 of the inner cylinder 14 includes at least one ratchet mechanism 28. The example includes four ratchet mechanisms 28 spaced circumferentially from one another. More than four or fewer than four ratchet mechanisms 28 could be used in other examples. Each example ratchet mechanism 28 is a linear gear with teeth 29 and extends both axially and circumferentially along the outer surface 26, extending circumferentially clockwise as they extend axially upward toward the cover plate 16.

The ratchet mechanisms 28 are configured to mesh with the ratchet mechanisms 18 of the outer cylinder 12. Thus, the number of ratchet mechanisms 28 of the inner cylinder 14 is equal to the number of ratchet mechanisms 18 of the outer cylinder 12. The teeth 29 are configured to mesh with the teeth 19 of the corresponding ratchet mechanism 18, providing a plurality of distinct ratcheting positions for adjustment. The ratchet mechanisms 18, 28 may be cast with their respective cylinders or may be separate components attached to their respective cylinders.

Because the inner cylinder 14 is configured to be inserted through the top of the outer cylinder 12, the ratchet mechanisms 28 at a given circumferential position are axially above the ratchet mechanisms 18 at the given circumferential position when meshed. The ratchet mechanisms 18 are configured to support the inner cylinder 14 such that the inner cylinder 14 does not move downward relative to the outer cylinder when the ratchet mechanisms 18, 28 are engaged.

One of the outer cylinder 12 and the inner cylinder 14 can include a cover plate 16 for covering the manhole. The cover could be a separate structure in another example. In the example, the cover plate 16 is disposed on the inner cylinder 14. Further, the example cover plate 16 is integral with the inner cylinder 14, which can reduce the possibility of a cover plate blowout during a storm water surge.

The cover plate 16 includes a plurality of slots 22 configured to receive tools for adjusting the assembly 10. In the example, two slots 22 are utilized, but more or fewer slots are contemplated. The example slots 22 are spaced 180 degrees from each other, each at the same radial distance from axis "A". The example slots 22 are linear and further illustrated in FIG. 4. Other types of openings are contemplated. The cover plate 16 extends radially outward of the outer surface 26 of the inner cylinder 14 to create an undersurface 24 of the cover plate 16. In one example, the annular ring 20 and the cover plate 16 extend a radially equal distance from the axis "A".

Figure 5:
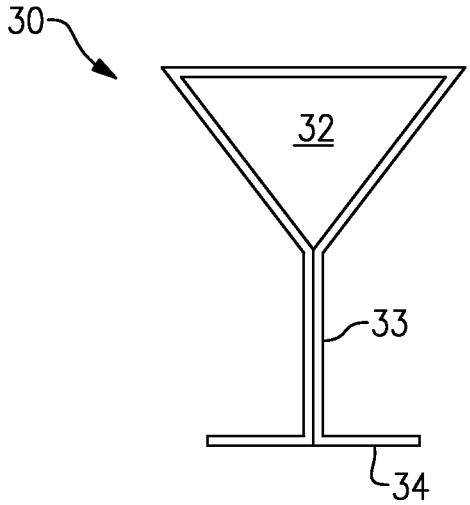
FIG. 5 illustrates an example tool for adjustment of the adjustable manhole cover assembly of FIG. 1.

FIG. 5 illustrates an example tool 30 for adjusting the assembly 10. The example tool 30 includes a handle 32 and a vertically linear member 33 extending from the handle 32. A horizontally linear member 34 is connected and perpendicular to the vertically linear member 33 at an opposite end from the handle 32.

The horizontal member 34 and the vertically linear member 33 are configured to be inserted into the slots 22. After insertion, the tool 30 is rotated 90° about an axis through the vertically linear member 33, whereupon the horizontally linear member 34 can be used to lift upward on a bottom surface of the cover plate 16, which in turn lifts the inner cylinder 14. This upward lifting will disengage ratchet mechanism 28 from ratchet mechanism 18, whereupon rotation of the cover plate 16 about the axis A in one direction will raise the cover plate 16 with respect to the outer cylinder 12, and rotation of the cover plate 16 about the axis A in the opposite direction will lower the cover plate 16 with respect to the outer cylinder 12. After rotation, the inner cylinder 14 may then be lowered to reengage the ratchet mechanism 18 with the ratchet mechanism 28. With an equal number of ratchet mechanisms 28 and 18, the assembly 10 self-aligns, not requiring any further alignment after adjustment.

Figure 6:
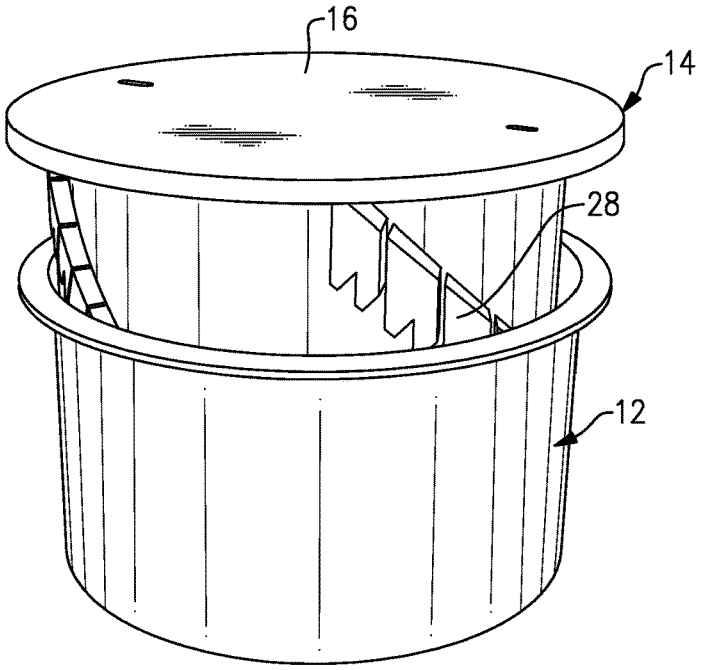
FIG. 6 shows a perspective view of the adjustable manhole cover assembly of FIG. 1 at a different axial position.
Figure 6A:
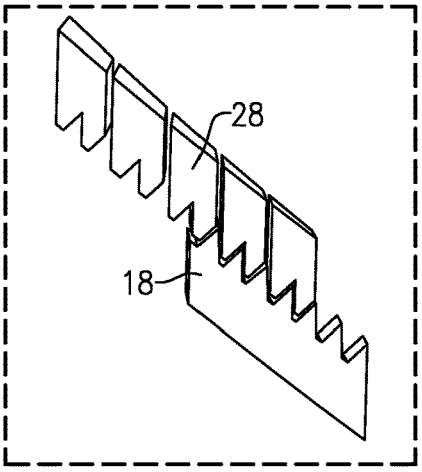
FIG. 6A shows a ratchet mechanism of the adjustable manhole cover assembly of FIG. 6.

A raised cover plate 16 and inner cylinder 14 are shown in FIG. 6. FIG. 6A shows the ratchet mechanism 18 engaged with the ratchet mechanism 28 when the cover plate 16 and inner cylinder 14 are at the position shown in FIG. 6. FIG. 1A shows the ratchet mechanism 18 engaged with the ratchet mechanism 28 when the cover plate 10 and inner cylinder 14 are at the position shown in FIG. 1, a lower axial position than the position shown in FIG. 6.

Figure 6B:
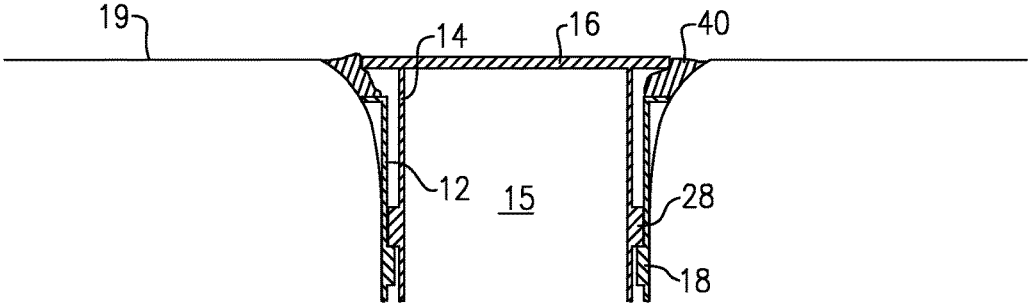
FIG. 6B shows a cross-sectional view of the adjustable manhole cover assembly at the axial position of FIG. 6 within an access hole.

FIG. 6B shows the height of the cover plate 16 at the position shown in FIG. 6. The cover plate 16 can thus be adjusted to a vertical position relatively equal to the surrounding surface 19. In one example, the gap 40 between the radially outer edge of the cover plate 16 and the access hole 15 may then be filled.

Figure 7:
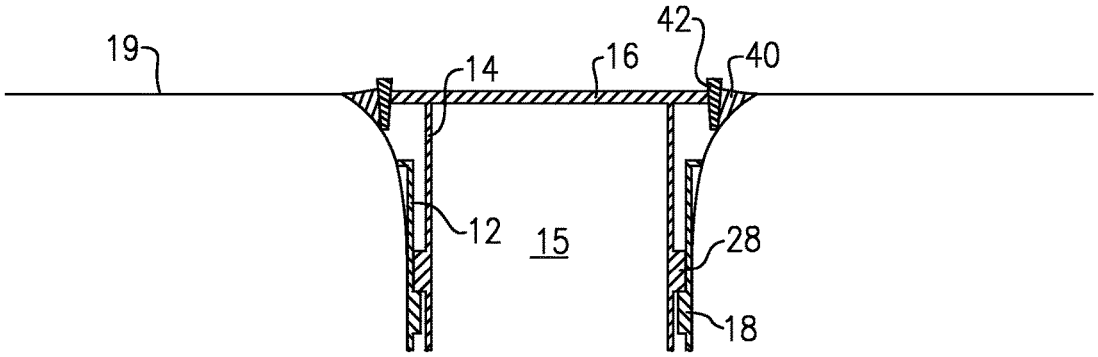
FIG. 7 shows a cross-sectional view of the adjustable manhole cover assembly and an example retainer ring.

FIG. 7 shows an alternative method for filling the gaps 40. A retainer ring 42 is provided around the outer circumference of the cover plate 16 before filler is added to the gap 40. The retainer ring 42 prevents filler from flowing downward to the gearing 18, 28. In one example, the thickness at the upper axial end of the retainer ring 42 is greater than the thickness at the lower axial end of the retainer ring 42, allowing for easy removal of the retainer ring 42 after the filler solidifies. The upper edge of the retainer ring 42 may be axially above the cover plate 16, also allowing for easy removal. The retainer ring 42 may be utilized for significant height differences between the cover plate 16 and the outer cylinder 12.

The example cover plate 16 has two slots 22, which would require two tools 30 for adjustment. This allows a single person to adjust the assembly 10, without assistance from machinery or other people. Further, because the example cover plate 16 is integral with the inner cylinder 14, the manhole remains covered during adjustment, substantially increasing safety.

The example assembly 10 has four ratchet gears offering full weight gearing, designed to be free of salt and sand and road debris contaminants.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A manhole cover assembly comprising:

an inner cylinder;

an outer cylinder;

a cover plate at an axial end of said inner cylinder, said cover plate extending radially past an outer surface of said inner cylinder, wherein said cover plate provides an undersurface extending radially outward of said outer surface of said inner cylinder;

an upper ratchet mechanism extending axially and circumferentially about an outwardly facing surface of said inner cylinder;

a lower ratchet mechanism extending axially and circumferentially about an inwardly facing surface of said outer cylinder, said lower ratchet mechanism configured to mesh with said upper ratchet mechanism at one of a plurality of distinct ratcheting positions; wherein said cover plate is at a first elevation when said lower ratchet mechanism meshes with said upper ratchet mechanism at a first one of said plurality of distinct ratcheting positions, said cover plate is at a second elevation when said lower ratchet mechanism meshes with said upper ratchet mechanism at a second one of said plurality of distinct ratcheting positions, and said first elevation is different from said second elevation;

a retainer ring provided around an outer circumference of said cover plate, said retainer ring configured to prevent filler from flowing to said upper ratchet mechanism and said lower ratchet mechanism, wherein said retainer ring is separate and distinct from all portions of the outer cylinder, and said retainer ring is radially outside said inner cylinder; and an adjustment tool having a handle, a first member, and a second member, said first member extending from said handle to said second member, said second member extending transversely from said first member, wherein said adjustment tool is configured to engage said cover plate by inserting said second member through a slot and rotating said adjustment tool such that said second member is positioned against said undersurface of said cover plate on a first side of said cover plate, and said handle is on an opposite, second side of said cover plate, wherein said adjustment tool is configured to engage said cover plate to lift said inner cylinder to disengage said upper and lower ratchet mechanisms such that said upper and lower ratchet mechanisms can be adjusted between said plurality of distinct ratcheting positions.

2. The manhole cover assembly as recited in claim 1, wherein said slot is a linear slot extending from the first side of said cover plate to said second side of said cover plate.

3. The manhole cover assembly as recited in claim 1, wherein said cover plate is integral with said inner cylinder such that said assembly remains covered during adjustment with said adjustment tool.

4. The manhole cover assembly as recited in claim 1, wherein said outer cylinder is configured to receive said inner cylinder through a top opening of said outer cylinder.

5. The manhole cover assembly as recited in claim 1, wherein said upper ratchet mechanism is a first upper ratchet mechanism, said inner cylinder further comprises a second upper ratchet mechanism extending axially and circumferentially about said outwardly facing surface, and said first upper ratchet mechanism circumferentially spaced from said second upper ratchet mechanism.

6. The manhole cover assembly as recited in claim 5, wherein said inner cylinder further comprises a third upper ratchet mechanism extending axially and circumferentially about said outwardly facing surface, and said third upper ratchet mechanism is spaced circumferentially from said first and second upper ratchet mechanisms.

7. The manhole cover assembly as recited in claim 5, wherein said lower ratchet mechanism is a first lower ratchet mechanism, said outer cylinder further comprises a second lower ratchet mechanism extending axially and circumferentially about said inwardly facing surface, said first lower ratchet mechanism circumferentially spaced from said second lower ratchet mechanism, and said second upper ratchet mechanism is configured to mesh with said second lower ratchet mechanism at said one of said plurality of distinct ratcheting positions.

8. The manhole cover assembly as recited in claim 1, wherein a thickness at an upper axial end of said retainer ring is greater than a thickness at a lower axial end of said retainer ring, such that said retainer ring tapers down from said upper axial end to said lower axial end.

9. The manhole cover assembly as recited in claim 1, wherein said adjustment tool is a first adjustment tool and said slot is a first slot, and further comprising a second adjustment tool configured to engage said cover plate by inserting a portion of said second adjustment tool through a second slot and then rotating said adjustment tool such that said portion is positioned against said undersurface of said cover plate on a first side of said cover plate when a handle of said second adjustment tool is on said opposite, second side of said cover plate.

10. The manhole cover assembly as recited in claim 1, wherein said first member is a vertical member and said second member is a horizontal member.

11. The manhole cover assembly as recited in claim 1, wherein said first member and said second member together have a T-shaped profile and said handle has a triangular-shaped profile.

12. The manhole cover assembly as recited in claim 1, wherein said second member is configured to contact, exclusively, said undersurface when lifting said inner cylinder to disengage said upper and lower ratchet mechanisms.

13. The manhole cover assembly as recited in claim 1, wherein said outer cylinder includes an annular ring extending radially outward from an outer surface of said outer cylinder at an uppermost edge of said outer cylinder.

14. The manhole cover assembly as recited in claim 13, wherein a radially outermost surface of said annular ring is radially aligned with a radially outermost surface of said cover plate.

15. The manhole cover assembly as recited in claim 13, wherein said cover plate extends from said outer surface of said inner cylinder radially past said upper ratchet mechanism and said lower ratchet mechanism.

16. The manhole cover assembly as recited in claim 15, wherein said cover plate is configured to enclose said upper ratchet mechanism and said lower ratchet mechanism.

17. A manhole cover assembly comprising:

an inner cylinder;

an outer cylinder;

a cover plate integral with the inner cylinder, wherein the cover plate extends radially outward of an outer surface of said inner cylinder and having an upper surface and an undersurface, wherein said cover plate includes first and second linear slots that are circumferentially spaced from each other and each extend from said upper surface to said undersurface;

an upper ratchet mechanism extending axially and circumferentially about an outwardly facing surface of said inner cylinder;

a lower ratchet mechanism extending axially and circumferentially about an inwardly facing surface of said outer cylinder, said lower ratchet mechanism configured to mesh with said upper ratchet mechanism at one of a plurality of distinct ratcheting positions, said distinct ratcheting positions corresponding to distinct cover plate elevation positions, wherein said outer cylinder is vertically below said cover plate at each of the plurality of distinct ratcheting positions, such that no portion of the outer cylinder extends vertically above said undersurface of said cover plate;

a retainer ring provided around an outer circumference of said cover plate; and a first and a second adjustment tool, each adjustment tool comprising a horizontal member configured for insertion into said corresponding linear slot, said horizontal member configured to engage said undersurface of said cover plate to lift and rotate said inner cylinder after a rotation of said adjustment tool after insertion into said linear slot, wherein lifting of said inner cylinder with said adjustment tool is configured to disengage said upper and lower ratchet mechanisms such that said upper and lower ratchet mechanisms can be adjusted between said plurality of distinct ratcheting positions.

18. The manhole cover assembly as recited in claim 17, wherein said cover plate extends radially from said outer surface past said upper ratchet mechanism and said lower ratchet mechanism, said cover plate configured to enclose said upper ratchet mechanism and said lower ratchet mechanism.

19. The manhole cover assembly as recited in claim 17, wherein said linear slots are circumferentially spaced from each other 180 degrees.

20. The manhole cover assembly as recited in claim 17, wherein said horizontal member of said adjustment tools are configured to contact, exclusively, said bottom surface of said cover plate when lifting and rotating said inner cylinder.

* * * * *